United States Patent [19]

Castonguay et al.

[11] 4,251,702

[45] Feb. 17, 1981

[54] CIRCUIT BREAKER HAVING MULTIPLE SPRING ACTUATING MECHANISMS

[75] Inventors: Roger N. Castonguay, Terryville; Charles L. Jencks, Avon, both of Conn.

[73] Assignee: General Electric Company, New York, N.Y.

[21] Appl. No.: 52,276

[22] Filed: Jun. 25, 1979

[51] Int. Cl.[3] ..... H01H 5/10

[52] U.S. Cl. ..... 200/153 SC

[58] Field of Search ..... 200/153 SC, 153 H, 153 G; 335/173, 191, 17, 74

[56] References Cited

U.S. PATENT DOCUMENTS

| | | | |
|---|---|---|---|
| 2,581,181 | 1/1952 | Faure | 200/153 G |
| 3,286,067 | 11/1966 | Menickella et al. | 200/153 G |
| 3,569,652 | 3/1971 | Hauser | 200/153 SC |
| 3,832,504 | 8/1974 | Cellerini et al. | 200/153 SC |

*Primary Examiner*—Willis Little

*Attorney, Agent, or Firm*—Robert A. Cahill; Walter C. Bernkopf; Philip L. Schlamp

[57] ABSTRACT

A spring powered charging mechanism is operatively coupled with a spring powered, circuit breaker contact operating mechanism such that charging of the operating mechanism springs is powered exclusively by the charging mechanism springs as they discharge. The charging mechanism includes a prop controlled by the condition of the operating mechanism to releaseably sustain the charging springs in a fully charged condition, while the operating mechanism includes a hook to releaseably sustain the breaker contacts open against the urgence of fully charged operating mechanism springs. Consequently, the circuit breaker is capable of executing multiple contact opening and closing operations without recharging.

21 Claims, 13 Drawing Figures

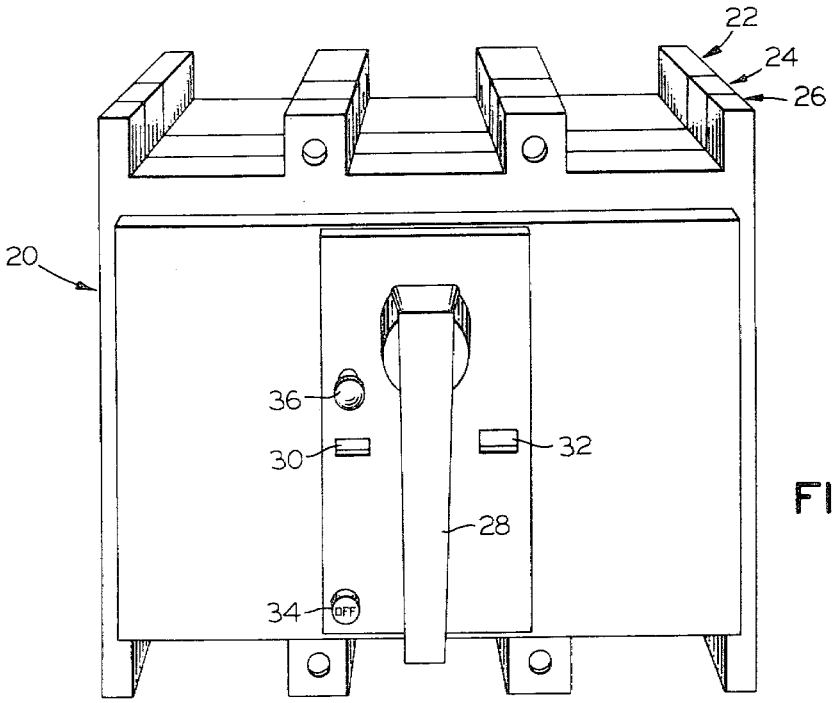
FIG.1
FIG.3
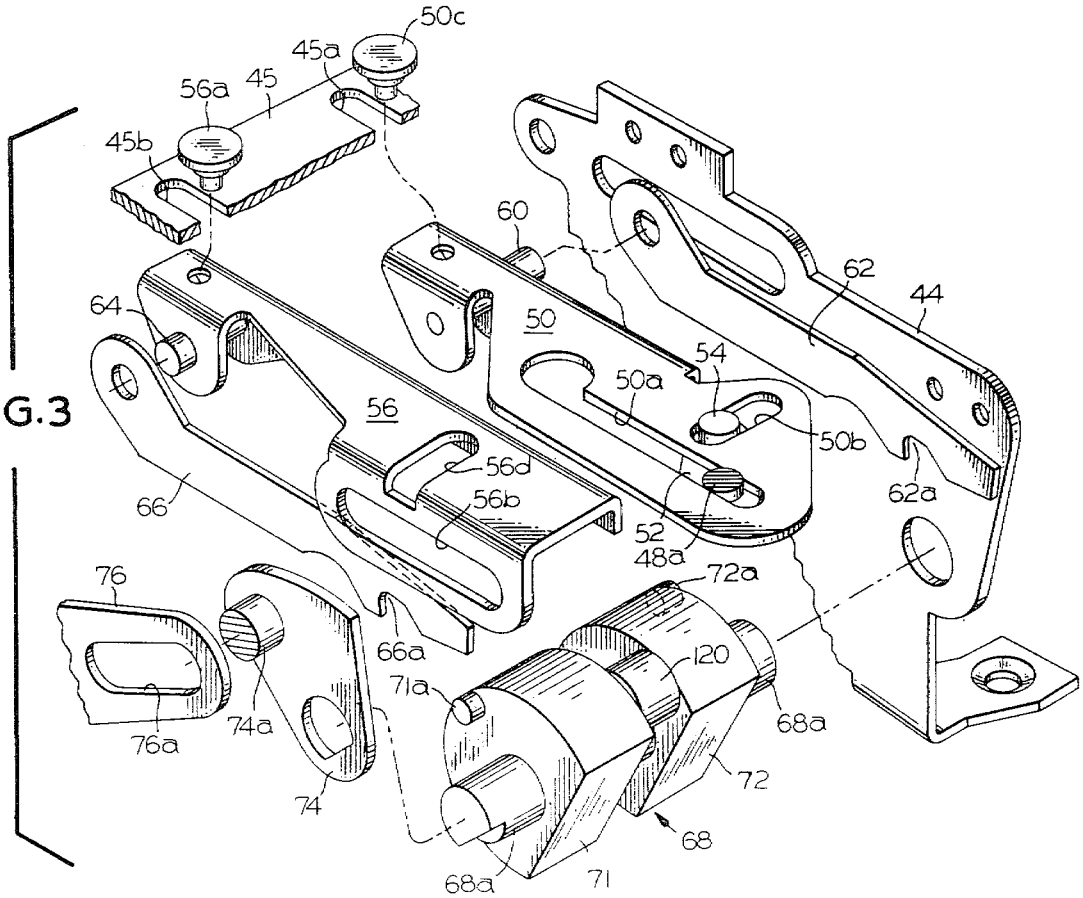

CIRCUIT BREAKER HAVING MULTIPLE SPRING ACTUATING MECHANISMS

REFERENCE TO RELATED APPLICATIONS

This disclosure of the instant application is common with the disclosures of commonly assigned, concurrently filed, applications, Ser. Nos. (51,587) and (52,051), which contain claims drawn to other inventions disclosed herein.

BACKGROUND OF THE INVENTION

The present invention relates to industrial circuit breakers and particularly to circuit breakers equipped with stored energy mechanisms.

In a number of rather specialized applications it is desirable that a circuit breaker be capable of immediately reclosing after it has opened. For example, in the case of critical circuits where service interruptions are tolerable only as an absolute necessity, it is desired that the circuit breaker protecting this circuit, when tripped open in response to a fault condition, immediately or after an established short time delay, reclose on the chance that the sensed fault condition was of a momentary nature. If indeed this is the case, electrical service is restored after a tolerably brief interruption. However, if the fault condition persists, the circuit breaker is again automatically tripped to interrupt service. Alternatively, the interval between breaker opening and reclosure may be utilized to allow time for a downstream branch circuit protective device to clear the fault condition. Thus, upon reclosure of the breaker, service is restored to the sound portion of the distribution circuit.

In another application of increasing commercial significance, stored energy, reclosure type circuit breakers are being utilized to protect electronic (static) circuit breakers in uninterruptible power supplies under fault conditions.

It is accordingly an object of the present invention to provide an improved stored energy, reclosure type circuit breaker.

An additional object is to provide a circuit breaker of the above-character which includes a stored energy mechanism capable of holding a charge while the breaker is in either its open or closed circuit conditions.

A further object is to provide a circuit breaker of the above-character which is capable of closing, opening, reclosing and reopening in rapid succession without recharging the stored energy mechanism.

Yet another object of the present invention is to provide a molded case, industrial circuit breaker of the above-character having an exceptional fast operating mechanism which is exceedingly compact in size and both versatile and reliable in operation.

Other objects of the invention will in part be obvious and in part appear hereinafter.

SUMMARY OF THE INVENTION

In accordance with the present invention, there is provided an industrial circuit breaker, which may be of the molded case type, having a spring powered contact operating mechanism and a spring powered charging mechanism. The contact operating mechanism functions to motivate the breaker contacts between their open and closed circuit positions. The charging mechanism, on the other hand, acts to empower the contact operating mechanism such that it can effect contact closure and subsequent contact opening. Thus, a unique characteristic of the instant circuit breaker is that charging of the contact operating mechanism springs, pursuant to empowering breaker closure and opening, is effected exclusively via the charging mechanism. To this end, the charging mechanism springs are designed such as to overpower the contact operating mechanism springs in that the latter can be charged incident with the discharging of the former.

More specifically, with the breaker contacts open and the contact operating mechanism springs discharged, the charging mechanism springs are charged. As the charging mechanism springs then discharge, the contact operating mechanism springs are incidentally charged to enable contact closure of the breaker. To accommodate breaker reclosure after it has been tripped open, the charging mechanism springs are again charged, and the charging energy is stored therein by a prop acting to prevent the charging springs from discharging. Consequently, the fully charged charging mechanism springs stand ready to recharge the contact operating mechanism springs immediately upon their discharge to effect opening of the breaker contacts. In accordance with a feature of the invention, the prop is removed incident with the breaker contacts springing to their tripped open position, thus enabling the charging springs to discharge and thereby recharge the contact operating mechanism springs. The circuit breaker can then close and subsequently reopen. It is thus seen that the charging mechanism can be pre-charged with the breaker contacts closed to enable the circuit breaker to subsequently open, reclose and reopen without recharging the charging mechanism.

In accordance with a signal feature of the present invention, the contact operating mechanism includes a hook operating to hold the breaker contacts in a hooked open position against the closing force of fully charged contact operating mechanism springs. Thus, with the breaker contacts in their tripped open positions, the prop is removed, and the charging mechanism springs are charged and then permitted to discharge. The contact operating mechanism springs are then charged, and the breaker contacts attempt to close, but are intercepted and held in an intermediate, hooked open position by the hook. The prop is then permitted to return to its charge storing position effective in preventing the charging mechanism springs, once recharged, from immediately discharging. It is thus seen that the charging mechanism springs can be double charged with the breaker contacts open to create the situation wherein both mechanism springs stand fully charged. The hook is removed to effect breaker contact closure at a desired moment in time without removing the prop. When the circuit breaker is subsequently tripped open, the prop is incidentally removed, and the charging springs discharge to recharge the contact operating mechanism springs. The breaker contacts spring to their hooked open position, ready to close upon removal of the hook. Once reclosed, the breaker contacts can be again tripped open to complete an open, closed, open, closed, open operating sequence without an intervening recharging of the charging mechanism springs.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings, in which:

DESCRIPTION OF THE DRAWINGS

FIG. 1 is an isometric view of a molded case industrial circuit breaker embodying the present invention;

FIG. 3 is an exploded perspective view of a portion of the charging mechanism utilized in the circuit breaker of FIG. 1;

Like reference numerals refer to like parts throughout the several views of the drawings.

DETAILED DESCRIPTION

Figure 2:
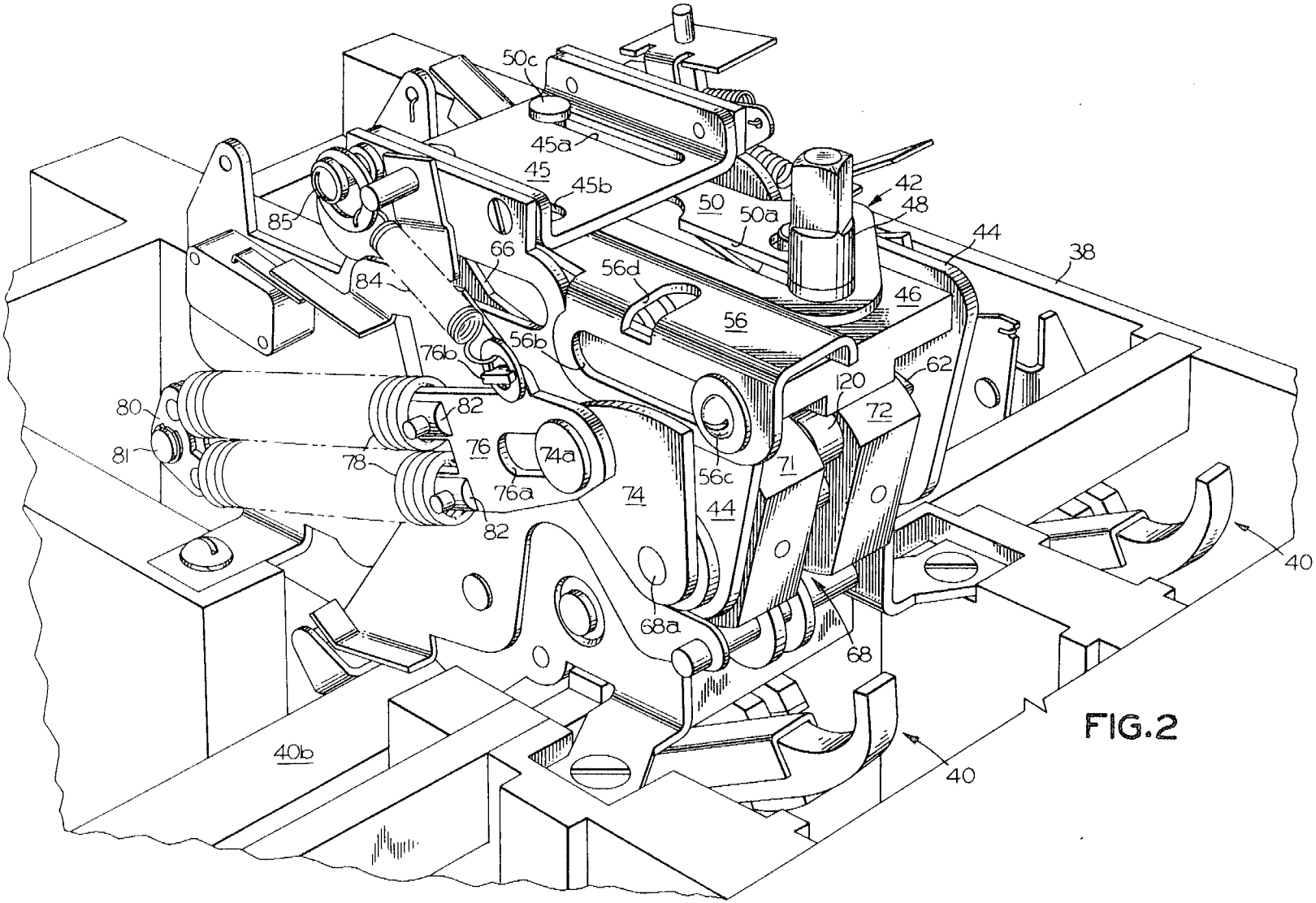
FIG. 2 is a perspective view of the overall operating mechanism utilized in the circuit breaker of FIG. 1.

Referring to FIG. 1, the circuit breaker of the present invention, generally indicated at 20, consists of, in one version, three basic assemblies, namely, a circuit breaker assembly 22, a power unit assembly 24, and a cover assembly 26, all secured together in stacked relation. In this version, the circuit breaker is capable of both manual and motor powered operations. To provide a strictly manually operated circuit breaker, power unit assembly 24 is simply omitted, leaving the cover assembly 26 stacked directly atop the circuit breaker assembly 22. As will be seen from the description to follow, circuit breaker assembly 22 includes a contact operating mechanism having basically the same construction as that disclosed in commonly assigned U.S. Pat. No. 4,001,742. It will also be noted from the description to follow that power unit assembly 24 has many of the structural features disclosed in commonly assigned U.S. Pat. No. 4,042,896. The disclosures of both of these patents are specifically incorporated herein by reference.

Still referring to FIG. 1, cover assembly 26 includes a manual operating handle 28 which may be cranked to manually charge circuit breaker 20. The cover assembly also includes windows 30 and 32 through which indicators are visible to identify the existing condition of the circuit breaker. Manual controls for conditioning the circuit breaker include an OFF button 34 and an ON pushbutton 36. The OFF pushbutton is depressed to trip the circuit breaker assembly 22, causing the circuit breaker contacts to spring from their closed circuit position to their open circuit positions. The ON pushbutton is depressed to cause the breaker contacts to spring from their open circuit position to their closed circuit positions once the breaker contact operating mechanism has been charged either via the power unit assembly 24 or the manual handle 28.

Figure 10:
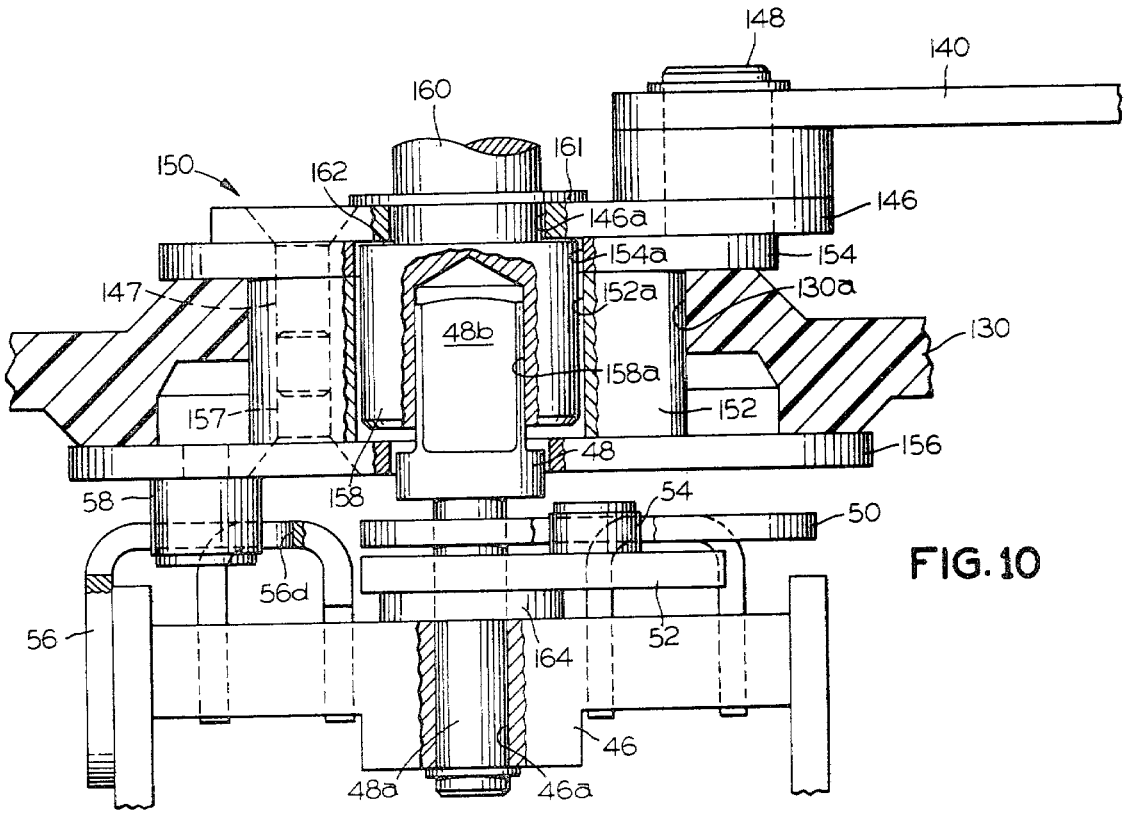
FIG. 10 is a sectional view of a hub assembly utilized in the circuit breaker of FIG. 1 to accommodate both manual and motor operator mechanism charging of the charging mechanism.

Circuit breaker assembly 22, seen in perspective in FIG. 2, includes a molded insulated base 38 in which three sets of movable contact assemblies 40 are mounted for pivotal movement between their open and closed circuit positions, preferably in the manner disclosed in the above noted U.S. Pat. No. 4,001,742. Base 38 also mounts a charging mechanism, generally indicated at 42, in the region generally above the center pole of circuit breaker 20. The various components of this mechanism are mounted by a frame consisting of a pair of parallel, spaced sideplates 44 spanned by a stringer plate 45 and a block 46. Block 46 serves to rotatably mount an upright stub shaft 48 which is drivingly coupled via a hub assembly seen in FIG. 10 to manual operating handle 28 of FIG. 1 and a motor operator mechanism seen in FIG. 8 and included in power unit assembly 24 of FIG. 1. As seen in FIGS. 3 and 10, the lower, reduced portion **48*a* of stub shaft 48 is received in a longitudinally elongated slot 50*a* formed in a manual operator slide 50. Fixed to shaft portion 48*a* is a crank arm 52 which carries at its free end an upstanding crank pin 54 operating in a transversely elongated slot 50*b* formed in slide 50. The rearward end of slide 50 carries a headed pin 50*c* which is received in an elongated slot 45*a* formed in stringer plate 45, thus completing the mounting of slide 50** to the mechanism frame.

As will be seen from the description to follow, counterclockwise rotation of shaft 48 by the handle swings crank arm 52 in the counterclockwise direction to propel slide 50, via pin 54 operating in slide slot **50*b*, through a rearward return stroke. Then, clockwise rotation of handle 28 back to its vertical position seen in FIG. 1 swings arm 52 in the clockwise direction, forcing slide 50** to execute a forward charging stroke.

Still referring to FIGS. 2 and 3, the mechanism frame additionally serves to mount in side by side relation with slide 50, a second, motor operator slide 56. This slide carries at its rearend a headed pin **56*a* which is received in an elongated slot 45*b* formed in stringer plate 45. The forward portion of slide 56 is turned down into overlying relation with left frame sideplate 44 and is provided with an elongated slot 56*b* in which is received the shank of a screw 56*c* (FIG. 2), completing the mounting of this slide to the mechanism frame. As will be seen, motivation of slide 56 to execute a rearward return stroke followed by a forward charging stroke is derived from the power unit assembly 24 via a pin 58 (FIG. 10) operating in a laterally extending slot 56*d*** formed in this slide.

To couple the forward charging stroke of manual operator slide 50 to the circuit breaker operating mechanism, a transverse pin 60 serves to pivotally mount the abruptly straightens toggle links 92, 94. While not shown in FIG. 4, the center pole movable contact assembly carries a control surface to hold hook 110 in its phantom line release position so as not to interfer with pin 96 during counterclockwise opening movement of the contact assemblies. An example of such a hook control surface may be found in U.S. Pat. No. 4,128,750.

Figure 4:
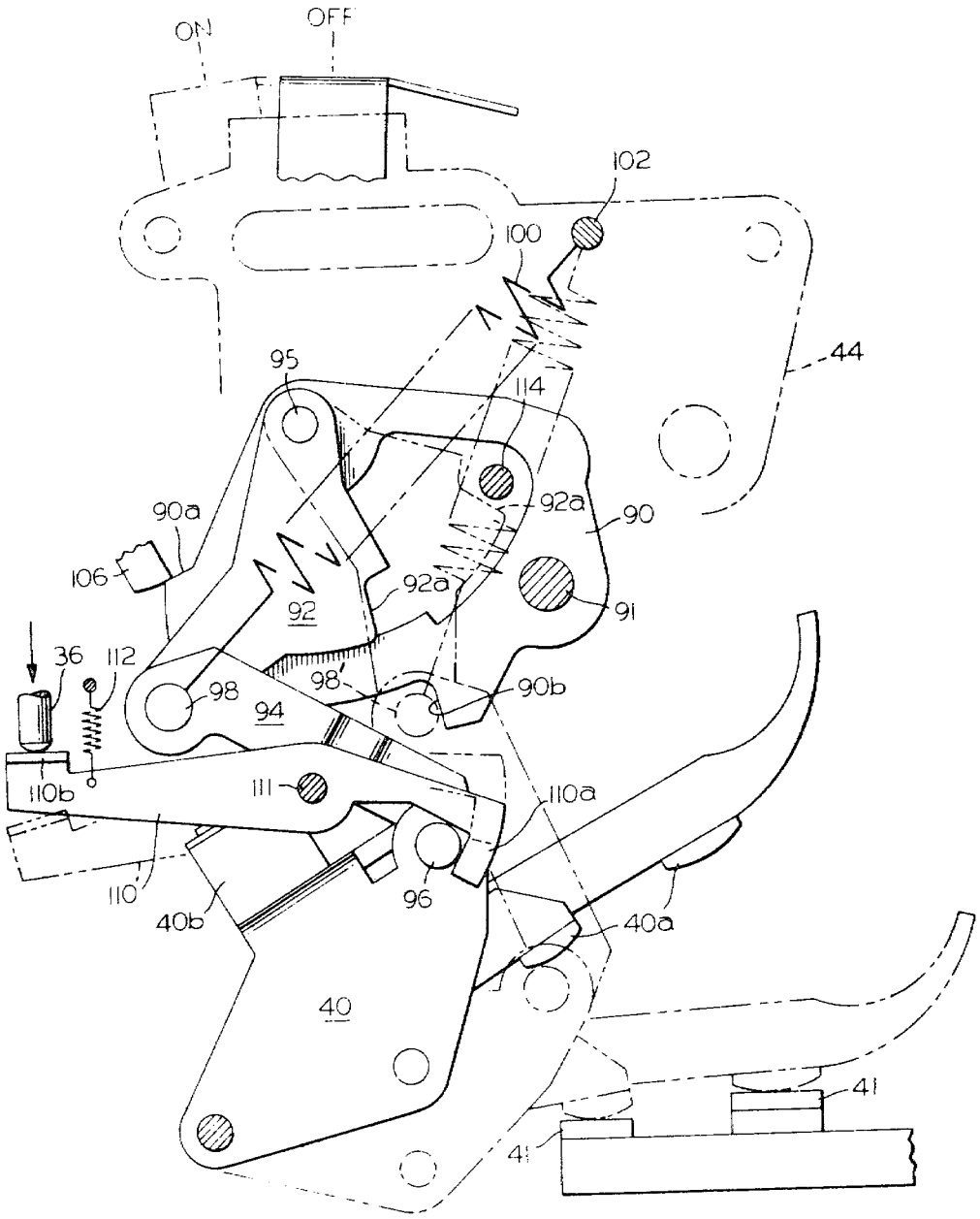
FIG. 4 is a side elevational view of the contact operating mechanism utilized in the circuit breaker of FIG. 1.

With the movable contact operating mechanism parts in their phantom line, closed circuit position seen in FIG. 4, toggle knee pin 98, seen in phantom at 98', engages a shoulder 90*b* of cradle 90 while latched in its reset position by latch 106. This shoulder serves as a stop to prevent the toggle from snapping over center and in fact stops the toggle just short of its fully straightened position. It will also be noted that with the contacts in their closed circuit positions, a shoulder 92*a* formed in upper toggle link 92 is positioned, as indicated at 92*a*, in contiguous relation with a stationary pin 114. Thus, when cradle 90 is released by a latch 106, either in response to depression of OFF pushbutton 34 of FIG. 1 or automatically in response to an overcurrent condition sensed by the circuit breaker's trip unit, clockwise pivotal movement of the cradle toward its tripped position under the urgence of mechanism spring 100 brings the upper toggle link shoulder 92*a* into engagement with pin 114, thereby accelerating the rate of collapse of the toggle. This action produces abrupt and accentuated separation of the circuit breaker contacts under the urgence of the discharging mechanism spring 100. Also contributing to the speed with which contact separation is achieved is the fact that the cradle shoulder 90*b* stops the toggle linkage short of its fully straightened condition while the breaker contacts are closed, as previously noted. Since the toggle does not have to snap through center to start the contact opening movement of the movable contact assemblies 40, contact separation is achieved that much more rapidly. That is, the initial movement of the toggle linkage upon unlatching of the cradle starts the collapse of the toggle which is further accentuated by the presence of pin 114. Contact separation is thus initiated without hesitation. In fact, under high fault conditions, contact separation may be initiated by the electromagnetic forces associated with the high fault currents prior to release of the cradle. It is seen that the toggle can accommodate this initial, forced contact separation by immediately beginning its collapse and the cradle, upon its release, catches up with the collapsing toggle linkage in completing the interruption without contact reclosure.

Figure 5:
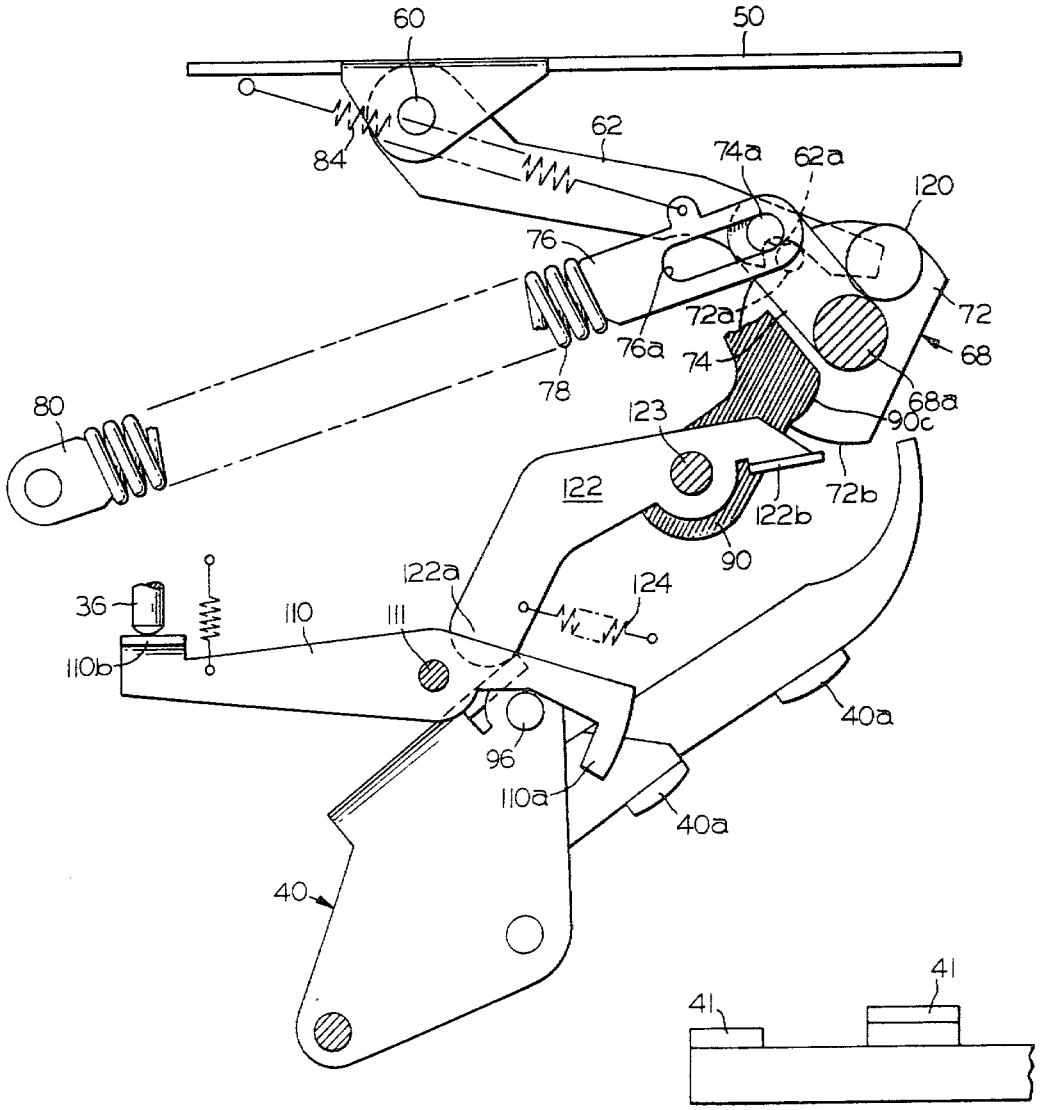
FIG. 5 is a simplified, side elevational view of the charging mechanism and the contact operating mechanism as the former is about to be charged.
Figure 6:
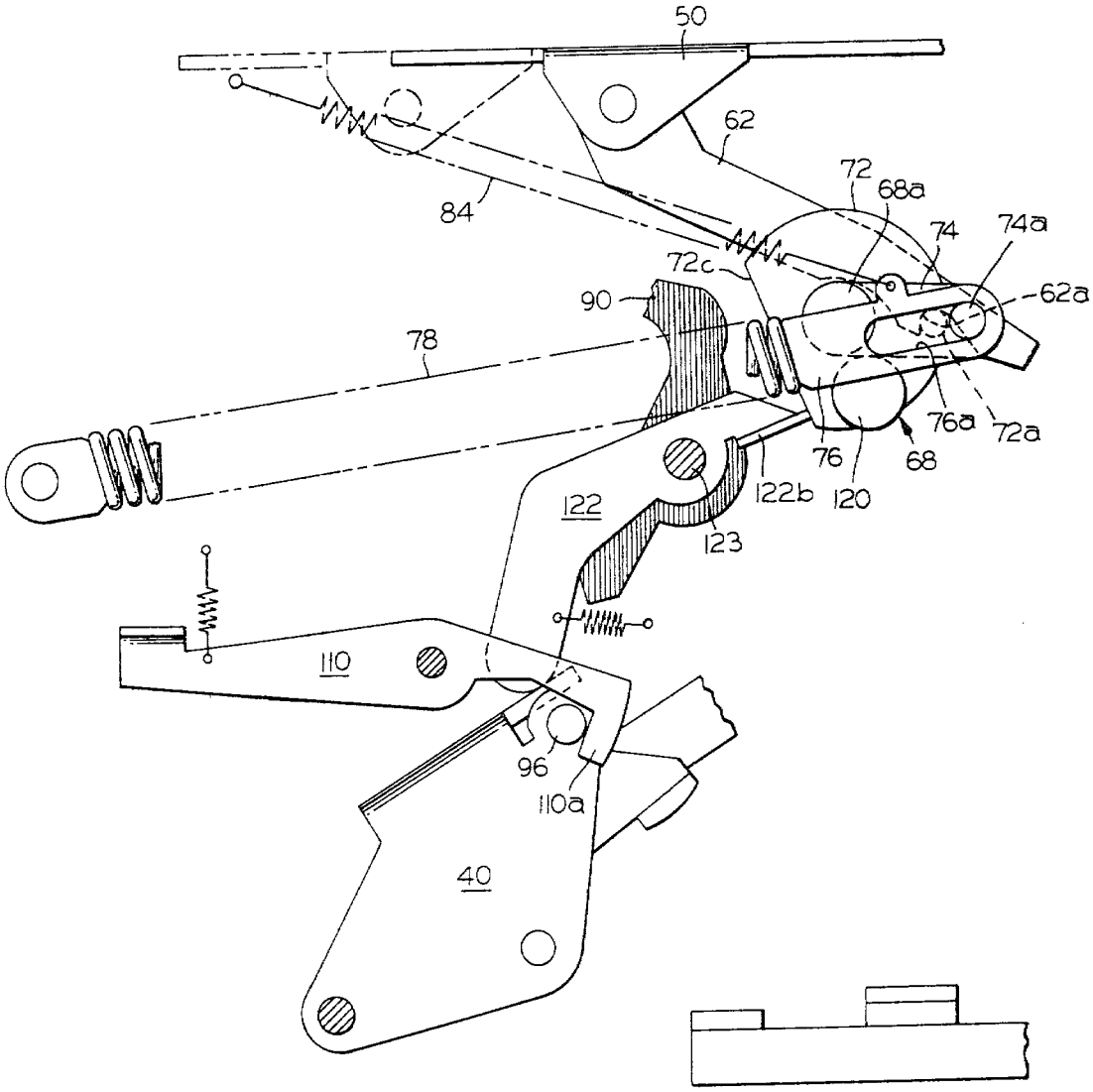
FIG. 6 is a simplified, side elevational view of the charging and contact operating mechanisms with charges stored in both mechanisms.
Figure 7:
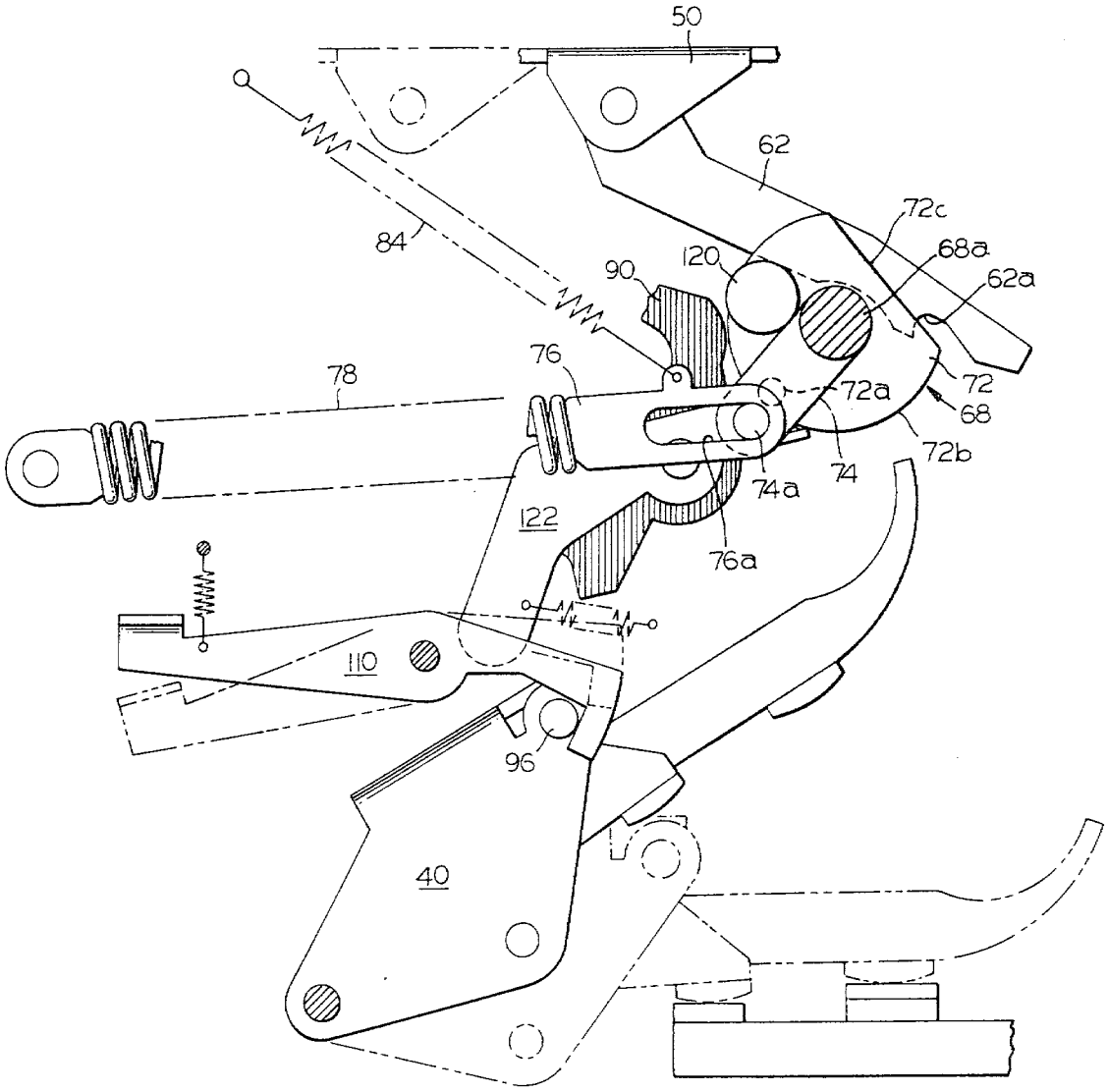
FIG. 7 is a simplified, side elevational view of the charging and contact operating mechanisms wherein the former is discharged and the latter is charged.

Reference is now had to FIGS. 5 through 7 for a description of the overall operation of the circuit breaker 20 of FIG. 1 and specfically the operation of the charging mechanism in resetting the contact operating mechanism of FIG. 4 pursuant to charging its spring 100. It will be recalled that the contact operating mechanism spring 100 is charged when cradle 90 is swung about its pivot pin 91 in the counterclockwise direction from a clockwise-most tripped position to bring its latching shoulder 90*a* into engagement with latch 106. To induce this resetting pivotal movement of cradle 90, the bell crank assembly 68, best seen in FIGS. 2 and 3, is provided with a reset roller 120 eccentrically mounted between the bell crank arms 71 and 72. As will be seen, when charging springs 78 discharge, bell crank assembly 68 is rotated to swing the reset roller around to engage cradle 90 while in its tripped position, driving it in the counterclockwise direction to its reset position, in the process charging the contact operating mechanism spring 100.

Referring first to FIG. 5, bell crank assembly 68 is seen in a start angular orientation achieved by the action of tension spring 84. Manual operator slide 50 is shown in its left-most return position with its pawl 62 retracted to a position where its notch 62*a* is in intercepting relation with pin 72*a* carried by crank arm 72 of bell crank assembly 68. At this point it should be pointed out that motor operation slide 56 and its drive pawl 66 act on bell crank assembly 68 in the same fashion as the manual operator slide and its drive pawl 62. Thus, the operation to be described in connection with FIGS. 5 through 7 applies whether it is initiated by reciprocation of manual operator slide 50 or motor operator slide 56. The only distinction is that the motor operator drive pawl 66 engages pin 71*a* carried by crank arm 71, whereas the manual operator drive pawl 62 engages pin 72*a* carried by crank arm 72.

From FIG. 6, it is seen that when slide 50 is driven to the right through a charging stroke by clockwise cranking movement of manual operating handle 28, drive pawl 62 is pushed to the right. Its notch 62*a* picks up pin 72*a*, causing bell crank assembly 68 to be rotated in the clockwise direction. When the bell crank assembly reaches its angular position of FIG. 6, it is seen that charging springs 78 are stretched to a charged state. It is assumed, at this point in the description, that the movable contact operating mechanism of FIG. 4 is tripped, and thus cradle 90 is in its clockwise-most tripped position seen in FIG. 5. Under these circumstances, the essentially discharged contact operating mechanism spring 100 has lifted the movable contact assemblies 40, to a counterclockwise-most, tripped open position seen in FIG. 5. In this position, the top surface of the center pole movable contact assembly engages and lifts the left lower end 122*a* of a prop 122 pivotally mounted intermediate its ends on a pin 123. The other, upper end 122*b* of this prop is moved downwardly out of an engaging relation with the arcuate surface portion of one of the bell crank arms against which it is normally engaged under the bias of a return spring 124. While in FIG. 7, prop 122 is shown as being biased into engagement with the arcuate surface portion 72*b* of crank arm 72, in practice, prop 122 acts against crank arm 71 simply as a matter of structural convenience.

As seen in FIG. 6, the rightward charging stroke of operator slide 50 is sufficient to carry the line of action of charging springs 78 through the axis of the bell crank assembly shaft 68*a*. Consequently, with prop 122 in its FIG. 5 position, the charging springs immediately discharge and the bell crank assembly is thereby driven in the clockwise direction, swinging reset roller 120 into engagement with a nose 90*c* of cradle 90 in its tripped position of FIG. 5. The cradle is thus swung in the counterclockwise direction to its reset position as the discharging springs 78 drive the bell crank assembly to its angular position seen in FIG. 7. As cradle 90 is being reset, contact operating mechanism spring 100 is charged to exert a bias tending to drive the movable contact assemblies 40 to their closed circuit positions seen in phantom in FIG. 7. However, hook 110 is in position to intercept pin 96 and detain the movable contact assemblies in a hooked open position seen in FIGS. 6 and 7. In this hooked open position, the center pole contact assembly releases the lower end 122*a* of prop 122, and its return spring 124 urges the other end 122*b* thereof into engagement with the arcuate surface rearward end of an elongated drive pawl 62 seen in FIG. 3. Similarly, motor operator slide 56 carries a transverse pin 64 pivotally mounting the rearward end of a second, identical drive pawl 66. A bell crank assembly, generally indicated at 68, includes a main shaft 68*a* rotationally mounted at its opposed ends by the frame sideplates 44. Pinned to this shaft are a pair of crank arms 71 and 72. Keyed to the left end of shaft 68*a* is an arm 74 which carries adjacent to its free end a headed pin 74*a* operating in an elongated slot 76*a* formed in a spring anchor 76 secured to the forward ends of a pair of powerful tension springs 78 seen in FIG. 2. Secured to the rearward ends of these tension springs is a spring anchor 80 which is affixed to the mechanism frame by a pin 81. Pinned to forward spring anchor 76 are a pair of elongated stop rods 82 which extend through the centers of tension springs 78 to abut against the rearward spring anchor 80. These stop rods are for the purpose of establishing a preloading of springs 78 of, for example, 100 pounds, and thus, when these springs discharge, the stop rods bottom out on the rearward spring anchor 80 before the spring convolutions can bottom out on themselves. This has the advantage of eliminating spring rebounding and also significantly reduces the potential for spring breakage.

Forward spring anchor 76, as seen in FIG. 2, is also provided with a laterally turned tab 76*b* which serves to anchor the forward end of a small tension spring 84. The rearward end of this spring is anchored by a screw 85 carried by the left frame sideplate 44. As will be seen, spring 84 serves to return bell crank assembly 68 to an appropriate starting angular position after springs 78 have discharged.

Still referring to FIGS. 2 and 3, pawl 62, pivotally connected to manual operator slide 50, is undercut to provide a notch 62*a* adapted to engage a pin 72*a* carried by crank arm 72 of bell crank assembly 68. It is thus seen that when slide 50 is propelled forwardly by clockwise cranking movement of manual handle 28, pawl 62 picks up pin 72*a*, causing the bell crank assembly to rotate in the clockwise direction. As will be seen from FIGS. 5 through 7, this action charges springs 78. In corresponding fashion, pawl 66, pivotally connected to motor operator slide 56, is undercut to provide a notch 66*a* which is adapted to pick up a pin 71*a* carried by bell crank arm 71 when this slide is motivated through a forward charging stroke by the motor operator assembly of FIG. 8. The bell crank assembly is thus rotated also in the clockwise direction effective to charge springs 78.

As will be seen from the description to follow, charging springs 78, once charged, are sufficiently forceful to overpower a spring powered breaker contact operating mechanism, such that the discharge of these springs is utilized to charge the contact operating mechanism springs which can then act to close and open the breaker contacts. Thus, the operator slides 50 and 56 do not operate directly on the breaker contact operating mechanism, but rather indirectly via the bell crank assembly 68 and the powerful charging springs 78. Moreover, as will become clear from the following description, charging mechanism 42 accommodates essentially indiscriminate stroking movements of operator slides 50 and 56, thus eliminating the need for any mechanical and/or electrical interlocking between the manual operating handle and the motor operator mechanism. This is achieved by virtue of the independent mounting of these operator slides and the utilization of separate drive pawls to propel the bell crank assembly pursuant to charging springs 78. Thus, should the motor operator mechanism stall at some point during charging of the charging mechanism, possibly due to loss of power, the charge can be completed by the manual operating handle.

Contact operating mechanism of circuit breaker 20, seen in FIG. 4, is constructed basically in the same fashion as disclosed in the above noted U.S. Pat. No. 4,001,742. Thus, a cradle 90 is pivotally mounted on a pin 91 supported by the frame sideplates 44. A toggle linkage comprising of an upper link 92 and a lower link 94 connects cradle 90 to center pole movable contact assembly 40. Specifically, the upper end of link 92 is pivotally connected to the cradle by a pin 95, while the lower end of link 94 is pivotally connected to the center pole movable contact assembly by a pin 96. The other ends of these toggle links are pivotally connected by a knee pin 98. Mechanism tension spring 100 acts between the toggle knee pin 98 and a pin 102 supported between the frame sideplates 44. In practice there are two mechanism springs 100, one to each side of the cradle 90 to thus balance the spring forces on the mechanism parts. The toggle links 92 and 94 are also preferably provided in pairs.

From the description thus far, it will be noted that the major distinction in the construction of the contact operating mechanism of FIG. 4 herein and that disclosed in U.S. Pat. No. 4,001,742 is that the operating lever included in the latter to couple the operating slide to the cradle pursuant to charging the mechanism springs is omitted in the instant construction. In the absence of this operating lever, to which the upper ends of the mechanism spring were pinned in the patented construction, the upper end of mechanism springs 100 seen in FIG. 4 are anchored to a stationary point, namely pin 102 carried by the mechanism sideplates 44. As will be seen, the function of the operating lever in the patented construction is assumed by the bell crank assembly 68 of FIGS. 2 and 3 in articulating the cradle 100 pursuant to charging mechanism springs 100. Moreover, by virtue of the position of spring anchoring pin 102, the line of action of charged spring 100, while cradle 90 is in its latched reset position sustained by the engagement of a latch 106 with cradle latch shoulder 90*a*, is always situated to the right of the upper toggle link pivot pin 95. Thus, the mechanism springs continuously act to straighten the toggle. Since straightening of the toggle forces the movable contact assemblies 40, ganged together by crossbar 40*b*, to pivot downwardly to their phantom line, closed circuit positions with their movable contacts 40*a* engaging stationary contacts 41, circuit breaker 20 is biased toward contact closure while cradle 90 is reset.

To control the moment of contact closure, a hook 110 is provided to hold movable contact assemblies 40 in a hooked open circuit position as the cradle is being reset from a clockwise-most tripped position to charge mechanism spring 100, thereby maintaining the toggle collapsed to the left as seen in FIG. 4. This hook is pivotally mounted on a pin 111 with its right hooked end 110*a* configured to engage pin 96 carried by the center pole movable contact assembly 40. A spring 112 biases the hook into engaging relation with pin 96. The left end of hook 110 is provided with a laterally turned flange 110*b* positioned to be engaged by the lower end of ON pushbutton 36 of FIG. 1 to release the movable contact assemblies 40 for contact closure as spring 100 portion 72*b* of bell crank arm 72 as seen in FIG. 7. By virtue of the loss motion coupling between bell crank assembly 68 and charging spring 78 afforded by slot 76*a* in its anchor 76, spring 84 acts to continue the clockwise rotation of bell crank assembly 68 from its angular position of FIG. 7 around to its start position of FIG. 5 with pin 74*a* again bottomed against the right end of slot 76*a* in charging spring anchor 76.

From the description thus far, it is seen that the first charge-discharge cycle of charging springs 78 has been effective in resetting the contact operating mechanism cradle 90 and charging the spring 100 thereof, but the breaker contacts are sustained in their open circuit positions by hook 110. At this point, the operator slide 50 can be motivated by handle 28 through a second rightward charging stroke to again charge springs 78. Since movable contact assemblies 40, in their hooked open position, have released prop 122, its upper end 122*b* rides off arcuate surface portion 72*b* of bell crank arm 72 as the bell crank assembly is rotated in a clockwise direction. Spring 124 serves to elevate end 122*b* of prop 122 into intercepting relation with the flattened surface 72*c* of bell crank arm 72 at the conclusion of the operator slide charging stroke just as the line of action of the charging springs 78 passes below the axis of bell crank assembly shaft 68*a*. Thus, as seen in FIG. 6, prop 122 serves to prevent further clockwise rotation of the bell crank assembly 68, and the charging springs 78 are held in a fully charged condition. It is thus seen that while the breaker contacts are held in their hooked open circuit position by hook 110, both the charging springs 78 and contact operating mechanism spring 100 are poised in their fully charged conditions. At this point, ON pushbutton 36 may be depressed, causing hook 110 to release the movable contact assemblies 40, whereupon they pivot to their closed circuit position under the urgence of mechanism spring 100. It will be noted that closure of the movable contacts has no effect on prop 122, and thus charging springs 78 are sustained in their fully charged condition.

When the circuit breaker 20 is eventually tripped open, either by depression of OFF pushbutton 34 or operation of the circuit breaker trip unit in response to an overcurrent condition, the unlatched cradle 90 swings to its tripped position, and the movable contact assemblies 40 abruptly pivot upwardly to their tripped open position of FIG. 5, all under the urgence of the discharging contact operating mechanism spring 100. As the center pole movable contact assembly 40 moves to its tripped open position, it picks up the lower end of prop 122, ducking its upper end 12*b* out of engagement with the flat peripheral surface portion 72*c* of crank arm 72. The clockwise rotational restraint on the bell crank assembly 68 is thus removed, and charging springs 78 abruptly discharge, swinging reset roller 120 around to drive cradle 90 from its tripped position of FIG. 5 back to its reset position of FIG. 7. The contact operating mechanism spring 100 is again charged, and the movable contact assemblies 40 moved to their hooked position seen in FIG. 6. At this point, the charging springs 78 may again be charged, and the charge therein will be automatically stored by prop 122 until needed to recharge the contact operating mechanism spring 100. Alternatively, and more significantly, hook 110 may be articulated by ON pushbutton 36 to precipitate closure of breaker 20, and thereafter the breaker may be tripped open without charging the charging springs 78.

From the foregoing description, it is seen that with the breaker contacts open and its contact operating mechanism tripped, the charging springs can be put through a first charge-discharge cycle to charge to contact operating mechanism spring 100 and then a second charge which is stored by prop 122 until needed to re-charge the mechanism spring 100. Thus, circuit breaker 20, starting in its tripped open condition and with two chargings of charging springs 78, can be closed, tripped open, reclosed and tripped open again without an intervening charging of the charging springs. It follows from this that the charging springs can be charged with the breaker contacts closed to achieve open, closed and open operations of the circuit breaker without an intervening charge.

Figure 8:
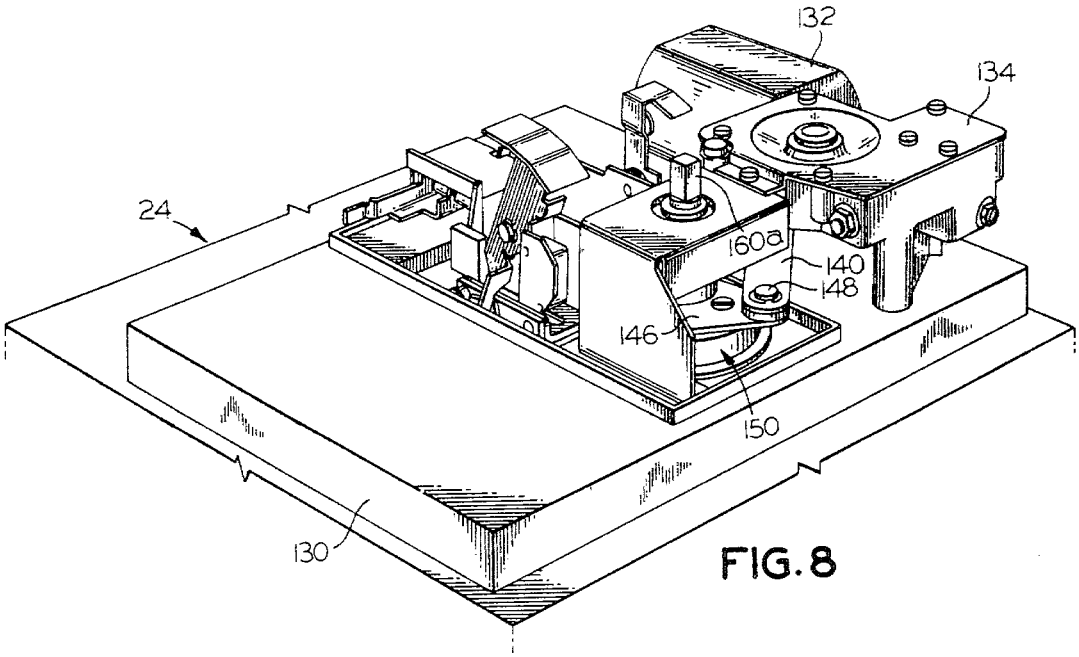
FIG. 8 is a perspective view of the motor operator mechanism utilized in the circuit breaker of FIG. 1.
Figure 9:
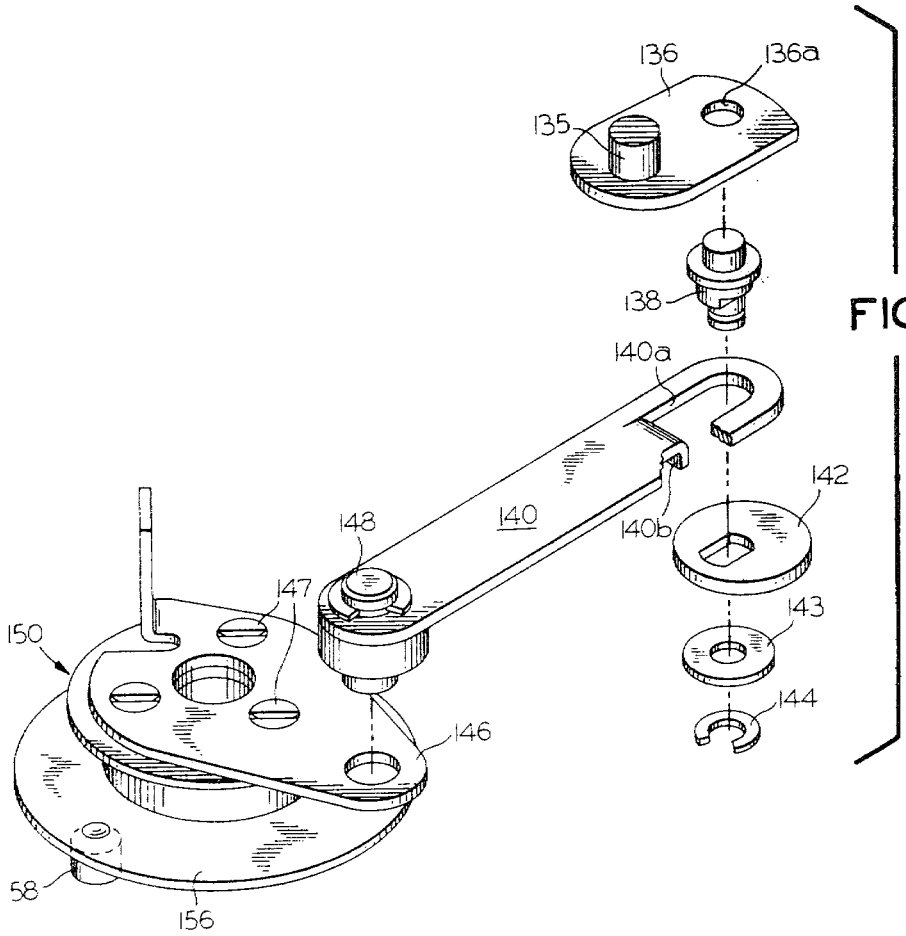
FIG. 9 is a perspective assembly view of a variable drive coupling link assembly utilized in drivingly coupling the motor operator mechanism of FIG. 8 to the circuit breaker charging mechanism.

The essential elements of power unit assembly 24 of FIG. 1 operating to reciprocate motor operator 56 in FIGS. 2 and 3 are shown in detail in FIGS. 8 through 13. Thus, as seen in FIG. 8, the power unit assembly 24 includes a molded insulative base 130 which, as seen in FIG. 1, is sandwiched between circuit breaker base 38 and the cover assembly cover. Supported atop this base is an electric motor 132 whose output shaft is drivingly connected to the input shaft (not shown) of a gear box 134. The construction of this gear box may take the form disclosed in above-noted U.S. Pat. No. 4,042,896. Keyed to the gear box output shaft, indicated at 135 in FIG. 9, is a crank arm 136. Adjacent the free end of this crank arm is a hole 136*a* in which the head of a shouldered pin 138 is inserted and peened over to fixedly secure it in place. The shank of this pin extends through an elongated longitudinal slot 140*a* in a link 140. A circular cam 142 is keyed on the shank of pin 138 in position below link 140. Finally, a washer 143 is inserted on the lower end of pin 138 and a snap ring 144 clipped in the very end retains the pin captured in slot 140*a* in link 140. The other end of link 140 is pivotally connected to a crank arm 146 by a pin 148. Crank arm 146 is secured by screws 147 to a hub assembly, generally indicated at 150 and mounted by base 130 of power unit assembly 24.

Referring to FIG. 10, hub assembly 150 includes an outer hub 152 which is received in an opening 130*a* provided in the power unit assembly base 130. An upper flange plate 154 is secured to the upper end of hub 152 by the screws 147 securing crank arm 146 to the hub assembly. A lower flange plate 156 is secured to the lower end of hub 152 by screws 157. It is thus seen that these flange plates serve to capture outer hub 152 for rotational movement in opening 130*a* of power unit assembly base 130. Pin 58, operating in slot 56*d* of motor operator slide 56, is eccentrically mounted to lower flange 156. As will be seen, the unidirectional rotation of the gear box output shaft 135 (FIG. 9) results in oscillatory rotation movement of outer hub 152 pursuant to reciprocating motor operator slide 56.

Still referring to FIG. 10, outer hub 152 and flange 154 are provided with respective central openings 152*a* and 154*a* in which is received a female square drive member 158. Integrally formed with this female drive member for upward extension through a reduced diameter opening 146*a* in crank arm 146 is a stub shaft 160 which terminates in a male square drive member 160*a* seen in FIG. 8. A snap ring 161 cooperates with the shoulder 162 between member 158 and stub shaft 160 to capture these elements in hub assembly 150 for rotational movement as an inner hub independently of outer hub 152. The upper, male square drive member end 160*a* of stub shaft 160 accommodates rotational drive coupling engagement with handle 28 when cover assembly 26 is assembled in place. Stub shaft 48, previously mentioned in connection with FIG. 2, is clearly shown in FIG. 10 with its reduced diameter lower end portion 48*a* journalled in a bore 46*a* provided in block 46. Crank arm 52 is affixed to this reduced stub shaft portion as is a flange 164 which cooperates with a snap ring 165 in capturing stub shaft 48 in mounting block bore 46*a* for rotational movement. As previously described, crank arm 52 mounts pin 54 which operates in slot 50*b* of manual operator slide 50. The upper end of stub shaft 48 is in the form of a male square drive member 48*b* which is received in the square sided central hole 158*a* provided in female square drive member 158 pursuant to drivingly coupling stub shaft 160 with stub shaft 48 and thus handle 28 with manual operator slide 50.

As will be seen in the following description in conjunction with FIGS. 11 through 13, a motor operator mechanism charging cycle is executed by swinging crank arm 136 through a full 360° revolution. During the initial portion of each crank arm 360° revolution, motor operator slide 56 is propelled from a home position through a return stroke, retract its pawl 66 into position where it can pick up pin 71*a* carried by a crank arm 71 of the bell crank assembly 68 (FIG. 3). During the concluding portion of each 360° revolution, slide 56 is driven forwardly through a charging stroke back to its home position, whereupon bell crank assembly 68 is rotated in the clockwise direction (FIGS. 5 through 7), pursuant to charging charging springs 78. As will be seen, link 140 is jointly acted upon by pin 138 and circular cam 142 so as to provide a lost motion coupling between the link and crank arm 136 effectuated at the conclusion of the motor operator slide charging stroke to decouple link 140 from crank arm 136. This lost motion coupling provides a coasting zone during which the de-energized motor 132 of FIG. 8 is permitted to coast to a stop without disturbing the motor operator slide home position achieved at the conclusion of its charging stroke. By virtue of this coasting zone, the necessity for special braking provisions to abruptly stop rotation of the motor output shaft at the conclusion of a charging cycle are rendered unnecessary. This constitutes a distinct advantage in terms of design efficiency and field reliability. Paradoxically, it will be seen that this coasting zone is achieved while maintaining equal clockwise and counterclockwise throws of crank 146, and thus equal length return and charging strokes of motor operator slide 56.

Figure 11:
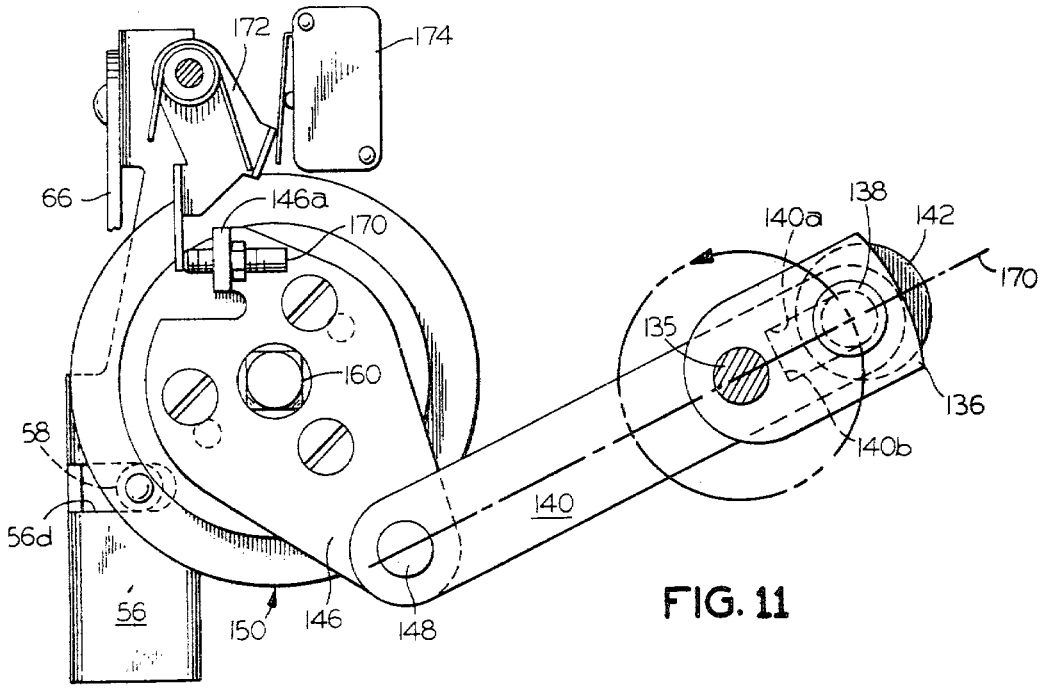
FIG. 11 is a simplified plan view of the link assembly of FIG. 9 at the conclusion of motor operator mechanism charging of the charging mechanism.

The motor operator mechanism drive parts are shown in FIG. 11 with the axes of gear box output shaft 135, pin 138 and pin 148 in alignment along a center line 170. Since pin 138 is aligned on the opposite side of output shaft 135 from pin 148, crank arm 146 has arrived at the end of its counterclockwise throw, and motor operator slide 56 has reached the end of its forward charging stroke, which is directed downwardly in FIG. 11. It will be noted that pin 138 is bottomed against the outer end of slot 140*a* in link 140, while the periphery of eccentrically mounted circular cam 142 is spaced from the inner end of this slot constituted by a downward turned tab 140*b* best seen in FIG. 9. As crank arm 136 is rotated in the counterclockwise direction by gear box output shaft 135 away from center line 170, pin 138 moves away from the outer end of slot 140*a*, and link 140 is simply swung in the counterclockwise direction about pin 148. It is not until the periphery of circular cam 142 moves into engagement with tab 140*b* at the inner end of slot 140*a* that any effective driving force is exerted on link 140 to swing crank 146 in the clockwise direction to begin a return stroke of motor operator slide 56 away from its home position. There is thus provided a lost motion connection between crank arm 136 and link 140 which creates a coasting zone through which crank arm 136 may revolve without exerting any driving force on crank arm 146 tending to move slide 56 from its home position. Thus, when pin 138 is revolved to its position in FIG. 11, motor 132 in FIG. 8 may be de-energized and simply allowed to coast to a stop without disturbing the home position of slide 56. Under these circumstances, special provisions to abruptly brake the motor at the conclusion of a slide charging stroke and thereby preserve the slide home position is rendered unnecessary.

To this end, crank arm 146 is provided with an upwardly turned flange 146*a* through which is adjustably threaded a set screw 170. When the parts are in their position shown in FIG. 11, screw 170 engages and pivots a lever 172 into actuating engagement with a normally closed switch 174. Upon actuation of this switch, the energization circuit for motor 132 is interrupted, and it is simply permitted to coast to a stop.

Figure 12:
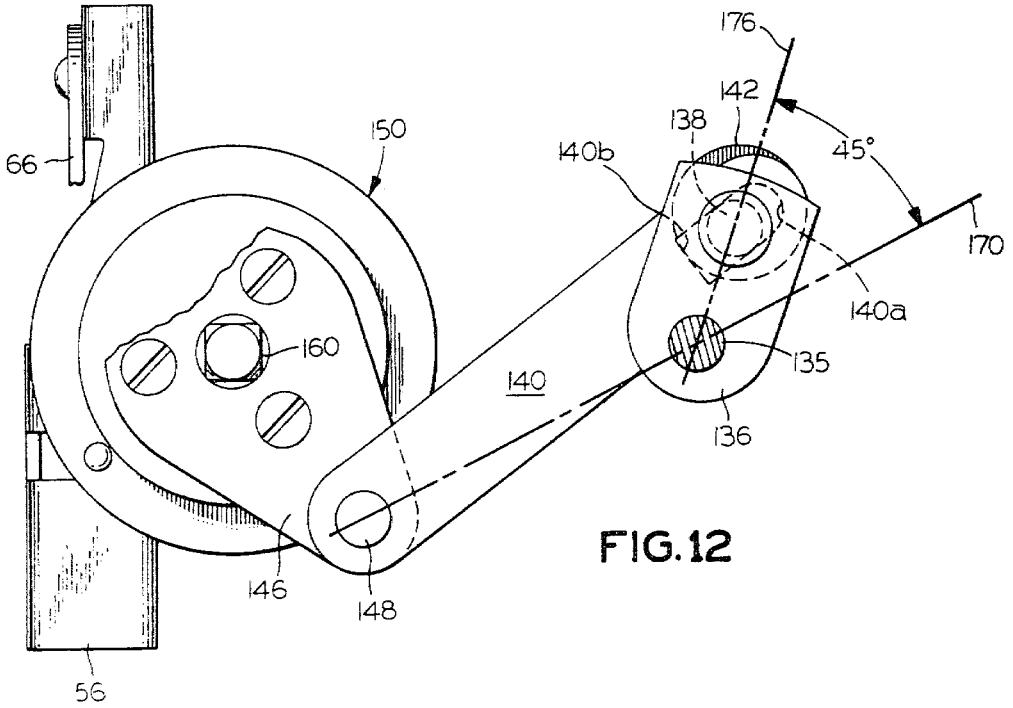
FIG. 12 is a simplified plan view of the link assembly of FIG. 9 at the beginning of a charging mechanism charging cycle.

In FIG. 12, the parts in FIG. 11 are seen in their positions assumed at the end of the coasting zone when the periphery of cam 142 has just moved into engagement with tab 140*b* at the inner end of slot 140*a*. In the illustrated embodiment, the configuration and dimensions of cam 142 is such as to provide a coasting zone of approximately 45° through which crank arm 136 can swing from centerline 170 to centerline 176 without exerting any driving force on crank arm 146. It is apparent that when cam 142 engages tab 140*b*, only then is driving force exerted on link 140, propelling crank arm 146 through its clockwise throw pursuant to initiating motor operator slide 156 return stroke away from its home position. It is noted that initially this driving force is exerted through a shortened effective driving length in link 140.

Figure 13:
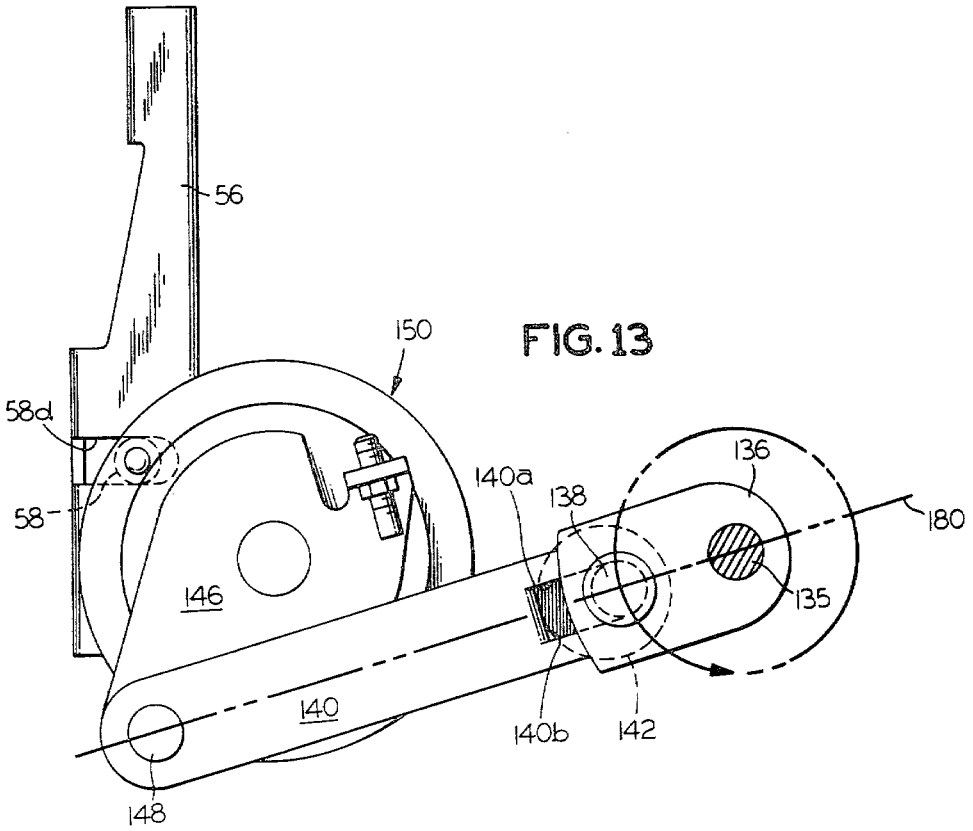
FIG. 13 is a simplified plan view of the link assembly of FIG. 9 as the charging mechanism is about to be charged.

In FIG. 13, the motor operator drive parts are shown in their positions assumed at the end of the clockwise throw of crank arm 146 to conclude the return stroke of slide 56. The axes of pin 148, gear box output shaft 135 and pin 138 are now aligned along a center line 180, with pin 138 between pin 148 and shaft 135. It is significant to note that circular cam 142 is now angularly oriented with its peripheral surface of maximum radius in engagement with tab 140*b*. This maximum radius is selected such as to return pin 138 into engagement with the outer end of slot 140*a* in link 140, thereby reestablishing this link to its full effective driving length. Consequently, the abrupt reduction in effective length of link 140 utilized during the coasting zone is progressively restored to its full driving length by the conclusion of the return stroke of the slide 66. Since the return stroke is very lightly loaded, the loss of mechanical advantage occasioned by the reduction in effective driving length is of no concern.

With continued counterclockwise position of crank arm 136 from its position seen in FIG. 13, it is seen that pin 138 is bottomed against the outer end of slot 140*a* in link 140, and crank arm 146 is pulled through its counterclockwise throw pursuant to propelling slide 56 through its forward charging stroke. When crank arm 136 swings back around to its position seen in FIG. 11, bringing the axis of pin 138 back into alignment with center line 170, the charging stroke is concluded. Slide 56 is thus returned to its home position, and, switch 174 is actuated. Motor 132 coasts to a stop, again without exerting the driving force of the crank arm 136 on motor operator slide 56 to disturb its home position.

Since by the conclusion of the operator slide return stroke (FIG. 13), link 140 has been restored to its full effective driving length (pin 138 bottomed against the outer end of link slot 140*a*), and this full effective driving length is sustained during the slide charging stroke, clockwise and counterclockwise throws of crank arm 146 are equal, as are the lengths of the operator slide return and charging strokes.

It will be appreciated that the operational effect of the pin 138—cam 142 with link slot 140*a* can be provided in other ways to achieve the desired coasting zone. For example, link 140 may be constituted by a toggle which is controlled such as to partially collapse at the end of the slide charging stroke. Return stroke drive is initially effected through the partially collapsed toggle. The toggle is then progressively cammed back to its straightened condition by the end of the return stroke. The toggle remains in its fully straightened condition as the operator slide is pulled through its forward charging stroke by crank arm 136. Moreover, the pin-cam means may be carried by the link to function with a slot in the crank arm pursuant to effecting the requisite coasting zone accommodating lost motion coupling.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described the invention, what is claimed as new and desired to secure by Letters Patent is:

1. A circuit breaker comprising, in combination:

A. a contact operating mechanism including
  (1) at least one movable contact arm,
  (2) a mechanism spring coupled with said contact arm and operative when charged to drive said contact arm to a closed position, said mechanism spring, upon discharging, driving said contact arm to an open position;

B. a charging mechanism including
  (1) means coupling said charging mechanism with said contact operating mechanism,
  (2) a charging spring connected with said coupling means and capable of being charged, upon subsequent discharge thereof, said coupling means being driven through a contact operating mechanism charging cycle pursuant to charging said mechanism spring, and
  (3) prop means controllably positioned by said contact operating mechanism to permit discharge of said charging spring when said contact arm assumes its open position and to prevent discharge of said charging spring when said contact arm is in its closed position; and C. circuit breaker operator means coupled with said charging mechanism to charge said charging spring.

2. The circuit breaker defined in claim 1, wherein said contact operating mechanism further includes hook means releaseably holding said contact arm in a hooked open position intermediate said open and closed positions against the bias of said charged mechanism spring, while said contact arm is in said hooked open position, said prop means being positioned to prevent discharge of said charging spring.

3. The circuit breaker defined in claim 2, wherein said contact operating mechanism further includes a cradle mounted for movement between a tripped position assumed in response to discharge of said mechanism spring and a reset position, said coupling means acting on said cradle during each contact operating mechanism charging cycle to drive said cradle from its tripped position to its reset position pursuant to charging said mechanism spring.

4. The circuit breaker defined in claim 3, which further includes a latch releaseably holding said cradle in its reset position pursuant to sustaining the charged condition of said mechanism spring, the line of action of said charged mechanism spring being continuously oriented to bias said contact arm toward said closed position while said cradle is in its reset position, said hook means arresting movement of said arm toward its closed position such as to hold said contact arm in its hooked open position.

5. A circuit breaker comprising, in combination:

A. a contact operating mechanism capable of assuming reset and tripped conditions,
  (1) at least one movable contact arm,
  (2) a mechanism spring capable of being charged incident with conversion of said operating mechanism from its tripped condition to its reset condition, said charged mechanism spring powering contact closure movement of said arm with said operating mechanism in its reset condition and contact opening movement of said arm upon conversion of said operating mechanism from its reset condition to its tripped condition, and
  (3) means selectively releaseably engaging said contact arm to restrain contact closure movement thereof under the urgence of said charged mechanism spring;

B. a charging mechanism capable of assuming charged and discharged conditions, said charging mechanism including
  (1) a charging spring capable of being charged incident with said charging mechanism assuming its charged condition and then capable of discharging to drive said charging mechanism to its discharged condition,
  (2) means coupling said charging mechanism with said operating mechanism such that the discharge of said charging spring converts said operating mechanism from its tripped condition to said reset condition, in the process charging said mechanism spring, and
  (3) means automatically responsive to the condition of said operating mechanism for selectively, releaseably detaining said charging mechanism in its charged condition; and C. motivating means drivingly coupled with said charging mechanism for powering the conversion thereof from its discharged to its charged conditions.

6. The circuit breaker defined in claim 5, wherein said charging mechanism further includes an operator member drivingly coupled with said motivating means for movement thereby through a charging stroke and a return stroke, and a drive element carried by said operator member for drivingly engaging said coupling means to convert said charging mechanism from its discharged condition to its charged condition in response to a charging stroke by said operator member, said drive element being drivingly decoupled from said coupling means during conversion of said charging mechanism from its charged to its discharged condition upon discharge of said charging spring.

7. The circuit breaker defined in claim 6, wherein said motivating means is in the form of a manual operating handle.

8. The circuit breaker defined in claim 6, wherein said coupling means is in the form of a bell crank assembly carried on a shaft for rotation in one direction from a start position to a charged position, a discharged position and back to said start position, said assembly including a crank arm connected at its free end to one end of said charging spring and an eccentric drive pin, said drive element being in the form of a pawl engaging said drive pin to rotate said assembly during an operator member charging stroke from its start position to its charged position where the line of action of said charged charging springs is swung through the axis of said shaft, whereby the discharge of said charging spring rotates said assembly to its discharged position.

9. The circuit breaker defined in claim 8, wherein said crank arm is connected to said charging spring via a lost motion connection to chargingly decouple said crank arm from said charging spring during rotation of said assembly from its discharged position to its start position, said charging mechanism further including separate spring means acting to rotate said assembly from its discharged position to its start position.

10. The circuit breaker defined in claim 9, wherein said detaining means selectively engages said bell crank assembly in its charged position to detain said charging mechanism in its charge condition.

11. The circuit breaker defined in claim 10, wherein said bell crank assembly eccentrically mounts a reset element to drivingly engage said contact operating mechanism pursuant to converting same from its tripped condition to its reset condition incident with movement of said assembly from its charged position to its discharged position.

12. A circuit breaker comprising, in combination:

A. a contact operating mechanism including
  (1) at least one contact arm mounted for movement between open and closed tripped positions,
  (2) a cradle mounted for movement between reset and tripped positions,
  (3) a toggle interconnecting said contact arm and said cradle and including a pair of links pivotally interconnected by a knee pin, said toggle maintaining said contact arm in its open position while collapsed and forcing said contact arm to its closed position when straightened,
  (4) a mechanism spring, connected between a fixed point and said knee pin and adapted to be charged as said cradle moves from its tripped position to its reset position, said charged mechanism spring acting to straighten said toggle while said cradle is in its reset position and discharging to collapse said toggle when said cradle is released from its reset position, incidentally with collapsing said toggle, said mechanism spring driving said cradle to its tripped position;

B. breaker opening means operable to release said cradle from its reset position;

C. a charging mechanism including
  (1) an operator member,
  (2) charging means mounted for movement between a charged position and a discharged position, said charging means drivingly coupled with said operator member,
  (3) means carried by said charging means for engagably moving said cradle from its tripped to its reset position incident with movement of said charging means from its charged to its discharged position,
  (4) a charging spring connected with said charging means such as to be charged incident with operator member driven movement of said charging means from its discharged to its charged position, whereupon said charging spring discharges to drive said charging means from its charged to its discharged position and thereby propel said cradle from its tripped to its reset position, thus charging said mechanism spring to empower straightening of said toggle, and
  (5) a prop selectively operable to releasebly detain said charging means in its charged position and thereby store the charge in said charging spring; and D. circuit breaker operating means drivingly coupled with said operator member.

13. The circuit breaker defined in claim 12, wherein said prop is controlled by said contact operating mechanism to detain said charging means in its charged position while said contact arm is in its closed position and to release said charging means from its charged position when said contact arm is in its open position and said cradle is in its tripped position.

14. The circuit breaker defined in claim 13, wherein said contact operating mechanism further includes a hook operable with said cradle in its reset position to releaseably engagably detain said contact arm in a hooked open position intermediate said open and closed positions against the bias of said charged mechanism spring, whereby said hook and prop function to respectively store charges in said mechanism and charging springs.

15. The circuit breaker defined in claim 14, which further includes breaker closing means acting on said hook to release said contact arm for movement from its hooked open position to its closed position.

16. The circuit breaker defined in claim 15 wherein said prop is controlled by said contact operating mechanism to also detain said charging means in its charged position while said contact arm is in its hooked open position, thereby enabling charges to be concurrently stored in said mechanism and charging springs.

17. The circuit breaker defined in claim 16, wherein said operator member is drivingly coupled with said circuit breaker operating means for movement thereby through a charging stroke and a return stroke, said charging mechanism further including a drive element connected with said operator member for drivingly engaging said charging means to drive same from its discharged position to its charged position in response to a charging stroke by said operator member, said drive element being drivingly decoupled from said charging means during movement of the latter from its charged to its discharged position as propelled by the discharge of said charging spring.

18. The circuit breaker defined in claim 17, wherein said charging means is in the form of a bell crank assembly carried on a shaft for rotation in one direction from a start position successively to said charged position, said discharged position and back to said start position, said assembly including a crank arm connected at its free end to one end of said charging spring and an eccentric drive pin, said drive element being in the form of a pawl engaging said drive pin to rotate said assembly during an operator member charging stroke from its start position to its charged position where the line of action of said charged charging spring is swung through the axis of said shaft, whereby the discharge of said charging spring drivingly rotates said assembly to its discharged position.

19. The circuit breaker defined in claim 18, wherein said crank arm is connected to said charging spring via a lost motion connection to chargingly decouple said crank arm from said charging spring during rotation of said assembly from its discharged position to its start position, said charging mechanism further including separate spring means acting to rotate said assembly from its discharged position to its start position.

20. The circuit breaker defined in claim 18, wherein said prop selectively engages said bell crank assembly in its charged position to store a charge in said charging spring.

21. The circuit breaker defined in claim 20, wherein said bell crank assembly eccentrically mounts a reset element to drivingly engage said cradle and drive same from its tripped position to its reset position incident with movement of said assembly from its charged position to its discharged position.

* * * * *